US011617422B2

(12) United States Patent
Fedderly et al.

(10) Patent No.: US 11,617,422 B2
(45) Date of Patent: Apr. 4, 2023

(54) CLEAT STRUCTURE FOR ARTICLE OF FOOTWEAR

(71) Applicant: NIKE, Inc., Beaverton, OR (US)

(72) Inventors: Josh A. Fedderly, Portland, OR (US); John Hlavacs, Portland, OR (US); Stuart Reinhardt, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 101 days.

(21) Appl. No.: 17/151,615

(22) Filed: Jan. 18, 2021

(65) Prior Publication Data

US 2021/0219666 A1 Jul. 22, 2021

Related U.S. Application Data

(60) Provisional application No. 62/961,746, filed on Jan. 16, 2020.

(51) Int. Cl.
*A43B 13/12* (2006.01)
*A43C 15/16* (2006.01)

(52) U.S. Cl.
CPC ..... *A43C 15/161* (2013.01); *A43B 13/122* (2013.01); *A43C 15/162* (2013.01)

(58) Field of Classification Search
None
See application file for complete search history.

(56) References Cited

U.S. PATENT DOCUMENTS

| | | | | |
|---|---|---|---|---|
| 7,624,515 | B2 * | 12/2009 | Kita | A43B 13/146 36/27 |
| 2010/0083541 | A1 * | 4/2010 | Baucom | A43C 15/14 36/25 R |
| 2014/0202042 | A1 * | 7/2014 | Berend | A43C 13/04 36/25 R |
| 2017/0224053 | A1 * | 8/2017 | Truelsen | A43B 3/0036 |
| 2019/0373981 | A1 * | 12/2019 | Luh | A43B 13/026 |
| 2019/0387835 | A1 | 12/2019 | Yahata et al. | |

FOREIGN PATENT DOCUMENTS

| | | | | |
|---|---|---|---|---|
| DE | 2634362 | A1 | 2/1977 | |
| GB | 191211841 | A | 2/1913 | |
| RU | 2704936 | C1 | 10/2019 | |
| WO | WO-2013072260 | A1 * | 5/2013 | A43B 5/02 |

* cited by examiner

*Primary Examiner* — Ted Kavanaugh
(74) *Attorney, Agent, or Firm* — Quinn IP Law

(57) ABSTRACT

A sole structure for an article of footwear includes a midsole having an upper surface and a ground-facing surface and a ground engaging sole component affixed to the ground-facing surface of the midsole. The ground engaging sole component includes a substrate layer, a support layer, and a plurality of cleats, each cleat coupled to the support layer and held apart from the midsole by a distance that is greater than 0.0 mm.

15 Claims, 5 Drawing Sheets

CLEAT STRUCTURE FOR ARTICLE OF FOOTWEAR

CROSS REFERENCE TO RELATED APPLICATIONS

The present application claims the benefit of priority from U.S. Provisional Patent Application No. 62/961,746, filed on 16 Jan. 2020, which is incorporated by reference in its entirety.

TECHNICAL FIELD

The present disclosure relates to a sole structure for an article of footwear and, more particularly, to a structure for supporting a plurality of ground engaging traction elements.

BACKGROUND

It is advantageous, when participating in various activities, to have footwear that provides traction and stability on the surface upon which the activities take place. Accordingly, the sole structures for articles of footwear have been developed with traction systems that include cleats to provide enhanced traction on a variety of surfaces. Examples include cleated shoes developed for outdoor sports, such as soccer, football, and baseball. In addition, articles of footwear have been developed with baseplate reinforcement features, such as shanks.

The present disclosure is directed to improvements in existing the sole structure traction and reinforcement systems.

DETAILED DESCRIPTION

Figure 1:
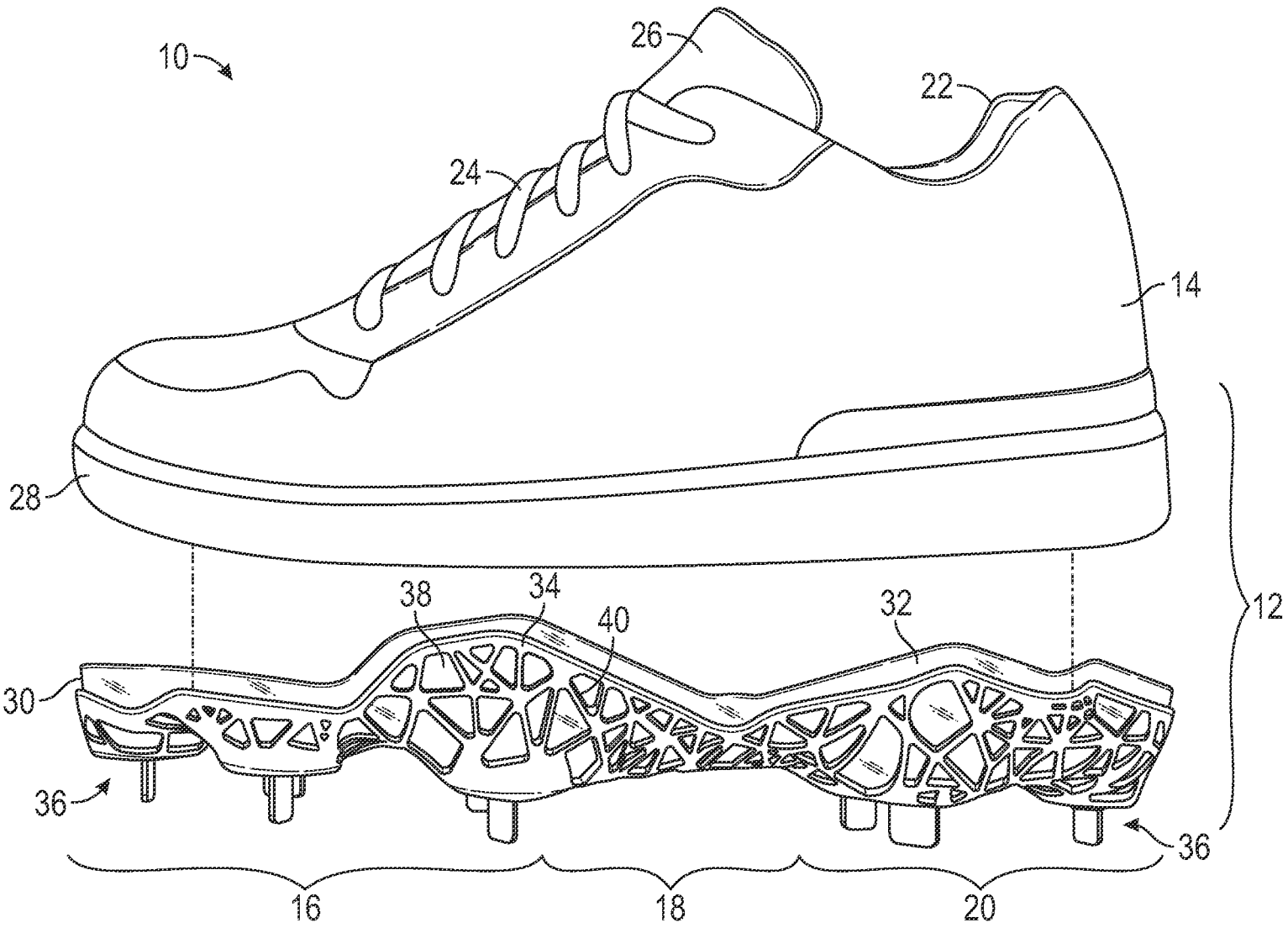
FIG. 1 is a schematic, partially exploded view of a cleated article of footwear.

The following discussion and accompanying figures disclose a sole structure for an article of footwear. Concepts associated with the footwear disclosed herein may be applied to a variety of athletic footwear types, including soccer shoes, baseball shoes, football shoes, golf shoes, and hiking shoes and boots, for example. Accordingly, the concepts disclosed herein apply to a wide variety of footwear types. While the present disclosure and drawings largely describe the use of metal, blade-style cleats/ground engaging elements, it should be understood that this is merely one example of a traction element that may be used. Depending on the specific sport or intended use, other protruding traction-promoting elements may be substituted, such as, and without limitation, posts, studs, claw-like protrusions (e.g., golf soft-spikes), or other protruding geometries. Similarly, such may be metallic or formed from a polymer, and may be either integrated or removable.

In general, the present disclosure relates to a sole structure for an article of footwear that includes a plurality of traction-promoting cleat elements as well as a novel cushioning system for distributing concentrated loads that may be experienced by the cleats when contacting the ground or another hard surface. In particular, each cleat or cleat pod is suspended apart from the midsole or an adjacent sole plate by an exo-skeleton-like structure that is capable of permitting local flex/translation of the cleat. While in some embodiments, the void between the cleat and the adjacent sole structure (plate or midsole) may be filled with a cushioning element such as an airbag, in other embodiments, it may be left unfilled.

For consistency and convenience, directional adjectives are employed throughout this detailed description corresponding to the illustrated embodiments. The term "longitudinal," as used throughout this detailed description and in the claims, refers to a direction extending a length of a sole structure, i.e., extending from a forefoot portion to a heel portion of the sole. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a sole. In other words, the lateral direction may extend between a medial side and a lateral side of an article of footwear, with the lateral side of the article of footwear being the surface that faces away from the other foot, and the medial side being the surface that faces toward the other foot.

The term "lateral axis," as used throughout this detailed description and in the claims, refers to an axis oriented in a lateral direction.

The term "horizontal," as used throughout this detailed description and in the claims, refers to any direction substantially parallel with the ground, including the longitudinal direction, the lateral direction, and all directions in between. Similarly, the term "side," as used in this specification and in the claims, refers to any portion of a component facing generally in a lateral, medial, forward, and/or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading towards the ground surface. Similarly, the terms "top," "the upper," and other similar terms refer to the portion of an object substantially furthest from the ground in a vertical direction, and the terms "bottom," "lower," and other similar terms refer to the portion of an object substantially closest to the ground in a vertical direction.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, and/or other joining techniques. In addition, two components may be "fixedly attached" by virtue of being integrally formed, for example, in a molding process.

Footwear Structure

FIG. 1 depicts an embodiment of an article of footwear 10, which may include a sole structure 12 and an upper 14 configured to receive a foot.

For reference purposes, footwear 10 may be divided into three general regions: a forefoot region 16, a midfoot region 18, and a heel region 20. Forefoot region 16 generally includes portions of footwear 10 corresponding with the toes and the joints connecting the metatarsals with the phalanges. Midfoot region 18 generally includes portions of footwear 10 corresponding with an arch area of the foot. Heel region 20 generally corresponds with rear portions of the foot, including the calcaneus bone. Regions 16, 18, and 20 are not intended to demarcate precise areas of footwear 10. Rather, regions 16, 18, and 20 are intended to represent general relative areas of footwear 10 to aid in the following discussion.

Since the sole structure 12 and the upper 14 both span substantially the entire length of footwear 10, the terms forefoot region 16, midfoot region 18, and heel region 20 apply not only to footwear 10 in general, but also to the sole structure 12 and the upper 14, as well as the individual elements of the sole structure 12 and the upper 14.

As shown in FIG. 1, the upper 14 may include one or more material elements (for example, textiles, foam, leather, and synthetic leather), which may be stitched, adhesively bonded, molded, or otherwise formed to define an interior void configured to receive a foot. The material elements may be selected and arranged to selectively impart properties such as durability, air-permeability, wear-resistance, flexibility, and comfort. An ankle opening 22 in heel region 20 provides access to the interior void. In addition, the upper 14 may include a lace 24, which may be utilized to modify the dimensions of the interior void, thereby securing the foot within the interior void and facilitating entry and removal of the foot from the interior void. Lace 24 may extend through apertures in the upper 20, and a tongue portion 26 of the upper 14 may extend between the interior void and lace 24. The upper 14 may alternatively implement any of a variety of other configurations, materials, and/or closure mechanisms. For example, the upper 14 may include sock-like liners instead of a more traditional tongue; alternative closure mechanisms, such as hook and loop fasteners (for example, straps), buckles, clasps, cinches, or any other arrangement for securing a foot within the void defined by the upper 14.

The sole structure 12 may be fixedly attached to the upper 14 (for example, with adhesive, stitching, welding, and/or other suitable techniques) and may have a configuration that extends between the upper 14 and the ground. The sole structure 12 may include provisions for attenuating ground reaction forces (that is, cushioning the foot). In addition, the sole structure 12 may be configured to provide traction, impart stability, and/or limit various foot motions, such as pronation, supination, and/or other motions.

The configuration of the sole structure 12 may vary significantly according to one or more types of ground surfaces on which the sole structure 12 may be used, for example, natural turf (e.g., grass), synthetic turf, dirt, snow, synthetic rubber surfaces (e.g., running tracks) and other indoor surfaces. In addition, the configuration of the sole structure 12 may vary significantly according to the type of activity for which footwear 10 is anticipated to be used (for example, running, hiking, soccer, baseball, football, and other activities).

The sole structure 12 may also vary based on the properties and conditions of the surfaces on which the footwear 10 is anticipated to be used. For example, the sole structure 12 may vary depending on whether the surface is harder or softer. In addition, the sole structure 12 may be tailored for use in wet or dry conditions.

In some embodiments, the sole structure 12 may be configured for a particularly specialized surface and/or condition. For example, in some embodiments, the sole structure 12 may include a sole for a soccer shoe configured to provide traction and stability on soft, natural turf surfaces in wet conditions. In some such embodiments, the sole structure 12 may include, for example, a fewer number of cleats (e.g., 2-6) that are aggressively shaped, and may have a comparatively larger size. Conversely, an alternative embodiment of the sole structure 12 may be configured to provide traction and stability on hard, artificial turf surfaces in dry conditions. In some such embodiments, the sole structure 12 may include, for example, a larger number of cleats (e.g., 7-20 or more), which may be relatively smaller in size, and/or may have less aggressive shapes. In one embodiment, the present sole structure may include between 3 and 15 cleats or between 5 and 9 cleats. While the number, size, and shape of cleats are provided for exemplary purposes, other structural parameters may be varied in order to tailor the shoe for traction and stability on various surfaces, and/or in a variety of conditions. Additional such parameters may include, for example, the use of secondary traction elements, placement of cleats, the relative softness or hardness of the cleats and/or the sole structure 12 in general, the relative flexibility of portions of the sole structure 12, and other such parameters. While the term "cleat" is well understood in the art, for the sake of clarity, a "cleat" is intended to refer to a projecting piece of metal or polymer that extends outward from the outsole of a shoe and is intended to at least partially penetrate or impress into a ground-surface for the purpose of enhancing the wearer's traction while reducing the occurrence of slip relative to the ground. To provide this traction, there are typically a finite and limited number of cleats on a sole structure so that the contact pressure between the cleat and the ground is sufficiently high to permit some degree of penetration.

The accompanying figures depict various embodiments of cleated shoes, having the sole structures suited for natural and/or synthetic turf. Although footwear 10, as depicted, may be suited for baseball, the design principles may described herein may be similarly used with cleated sole structures that are suited for other activities such as baseball, soccer, American football, and other such activities where traction and grip may be significantly enhanced by cleat members. In addition, various features of the disclosed the sole structures (and/or variations of such features) may be implemented in a variety of other types of footwear.

In some embodiments, the sole structure 12 may include multiple components, which may individually and/or collectively provide the footwear 10 with a number of attributes, such as support, rigidity, flexibility, stability, cushioning, comfort, reduced weight, and/or other attributes. In some embodiments, the sole structure 12 may include at least a midsole 28, and a ground engaging sole component 30, as shown in FIG. 1.

As noted above, footwear 10 is depicted in FIG. 1 as a baseball shoe, which may have a rather traditional impact attenuating/cushioning midsole 28. Despite this illustration, the present designs may also be applicable for cleated footwear 10 that does not include a cushioning midsole 28, but instead includes a reinforcing plate that provides rigidity to the sole structure 12 in place of the midsole 28 (e.g., a global football boot).

As generally illustrated in FIG. 1, the midsole 28 may be fixedly attached to a lower area of the upper 14 (for example, through stitching, adhesive bonding, thermal bonding (for example, welding), and/or other techniques), or may be integral with the upper 14. The midsole 28 may extend through each of regions 16, 18, and 20 and between the lateral and medial sides of footwear 10. In some embodiments, portions of midsole 28 may be exposed around the periphery of footwear 10. In other embodiments, midsole 28 may be completely covered by other elements, such as material layers from the upper 14. The midsole 28 may be formed from any suitable material having the properties described above, according to the activity for which footwear 10 is intended. In some embodiments, the midsole 28 may include a foamed polymer material, such as polyurethane (PU), ethyl vinyl acetate (EVA), or any other suitable material that operates to attenuate ground reaction forces as the sole structure 12 contacts the ground during walking, running, or other ambulatory activities.

Ground Engaging Sole Component

An article of footwear according to the present disclosure may include a sole structure 12 including a ground engaging sole component 30 fixedly attached to the bottom portion of the upper 14. The sole component 30 may include features that provide traction and stability on any of a variety of surfaces, and in any of a variety of conditions. In some embodiments, the sole component 30 may resemble a cage or web-like structure that provides an outsole or outer covering to the sole.

The sole component 30 may be formed by any suitable process. For example, in some embodiments, the sole component 30 may be formed by molding and/or may include aspects that are 3D printed. In addition, in some embodiments, various elements of the sole component 30 may be formed separately and then joined in a subsequent process. Those having ordinary skill in the art will recognize other suitable processes for making the sole components discussed in this disclosure.

Figure 2:
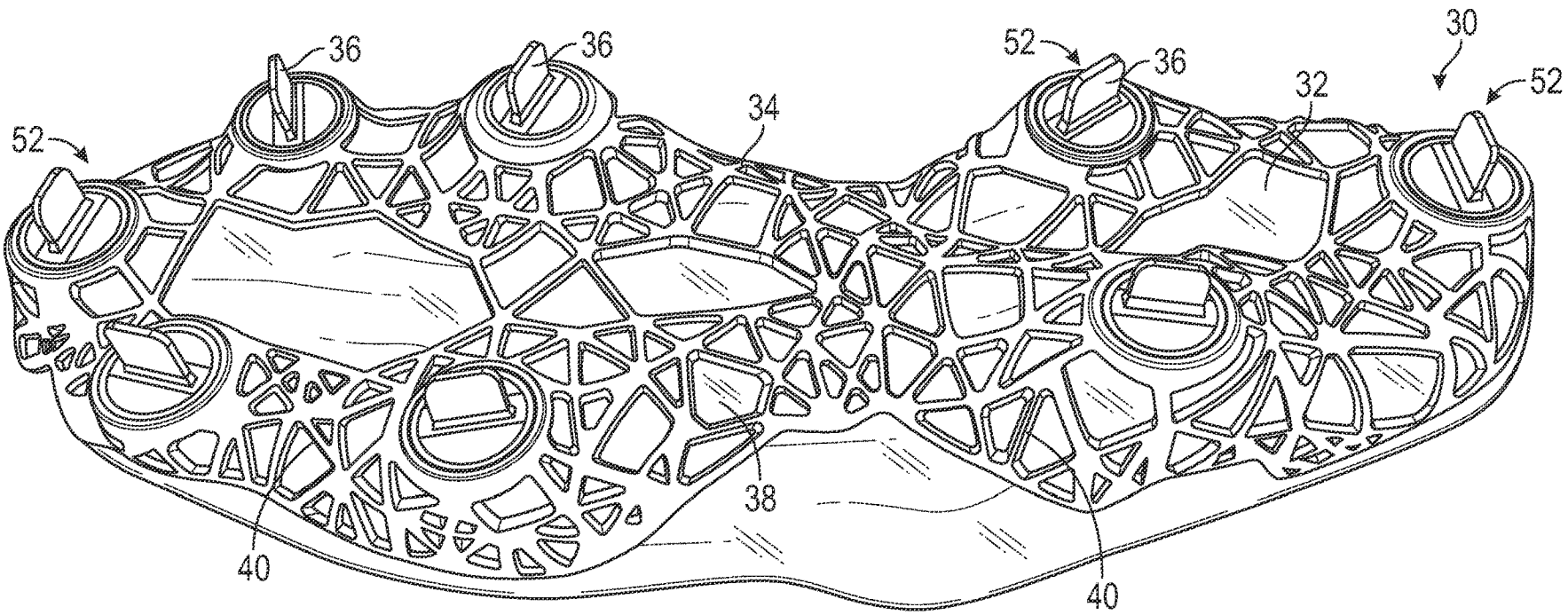
FIG. 2 is a bottom perspective view of a ground engaging sole component for a cleated article of footwear.

As generally illustrated in FIG. 2, the sole component 30 may include a substrate layer 32, a support layer 34, and one or more cleats 36 that extend downward from the substrate layer 32 and support layer 34. In some configurations, the support layer 34 may resemble a scaffold that includes a plurality of apertures 38 or voids that are defined between a plurality of adjoining scaffold segments 40. In some embodiments, these scaffold segments may be substantially linear in nature, and may serve to connect node points that are defined by the intersection of three or more segments 40. In the illustrated embodiment, each aperture 38 may be a polygon, and more particularly, in some embodiments, these polygonal apertures may be limited to triangular apertures and quadrilateral apertures. In some embodiments, the plurality of apertures may include at least 100 apertures, or between 50 and 400 apertures, or between 100 and 300 apertures, or between 200 and 250 apertures.

Figure 3:
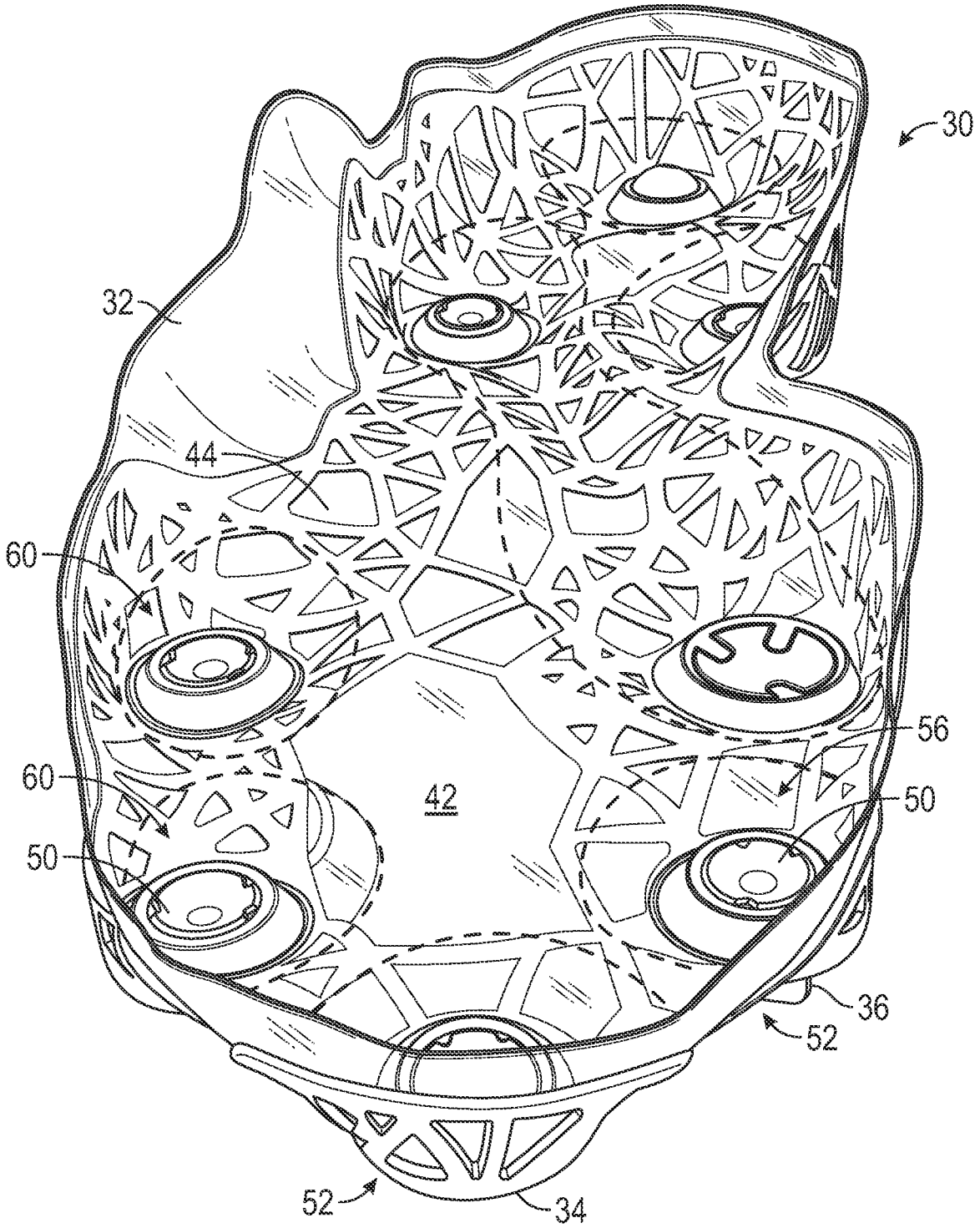
FIG. 3 is a top perspective view of a ground engaging sole component for a cleated article of footwear.

With reference to FIGS. 2-3, the support layer 34 may be integral with and/or otherwise affixed to the substrate layer 32. In one embodiment, the support layer may be 3D printed onto the substrate layer 32, such as using a fused filament fabrication technique. In other embodiments, the support layer 34 may be injection molded onto the substrate layer 32, such as via a co-molding or insert injection molding process. In still other embodiments, each layer 32, 34 may be separately formed and then fused, welded, or adhered together. In one configuration, the substrate layer 32 may comprise a polymeric sheet having a thickness of less than about 2.0 mm, or less than about 1.0 mm, or less than about 0.5 mm, or between about 0.025 mm and about 0.1 mm, or between about 0.1 mm and about 0.5 mm. In some embodiments, the substrate layer may comprise a fabric reinforced composite having an aramid or carbon weave embedded in a polymeric resin.

As further illustrated in FIGS. 2-3, the substrate layer 32 may extend across a substantial majority of the sole component 30. In some configurations, the substrate layer 32 may extend across the entire sole component, and may further form a concave recess within which the midsole 28 and/or upper 14 may be secured. In this manner, the substrate layer 32 may present a larger bond surface area to the immediately adjacent sole structure than would be available with only the support layer 34. As used herein, the "bond surface" 42 is the portion of the upper surface 44 of the ground engaging sole component 30 that is configured to directly contact/abut the adjacent portion of the sole structure 12 such that if an adhesive were present, it would form an adhesive bond between the two surfaces/structures. In addition to providing a greater bond surface than simply the support layer/scaffold alone, the substrate layer may also cover over each of the apertures 38 to prevent water or debris from becoming lodged within the overall structure.

In one configuration, each of the one or more cleats 36 may be held in a substantially constant position and orientation by the structural rigidity of the support layer 32 and/or substrate layer 34. In particular, each cleat 36 may comprise a respective base portion 50 and a ground engaging portion 52. The base portion 50 may extend into and/or through one or both of the support layer 34 and the substrate layer 32 of the sole component 30. Said another way, the base portion 50 may be positioned and/or may extend between the support layer 34 and the midsole 28 when assembled. Furthermore, in some configurations, the support layer 34 may encircle, surround, and/or entrap the base portion 50 to effectively tie it into the scaffold-like structure. As may be appreciated, the ground engaging portion 52 may protrude from a ground-facing side of the base portion 50 (i.e., the side opposite the remainder of the sole structure) and may be operative to impinge into a ground surface during normal use. In one embodiment, the ground-engaging portion 52 may comprise a blade, spike, post or claw-like structure (i.e., similar to a soft-spike that would traditionally be used with a golf shoe).

Referring to FIG. 3, in one configuration, the upper surface 40 of the ground engaging sole component 30 and/or substrate layer 32 has a contoured profile that includes a plurality of recessed areas 60 that are contoured away from the remaining sole structure. When attached to a substantially plain and/or flat midsole 28, the recessed areas may be held apart from the midsole 28 to define a volume 62 therebetween (best shown in FIG. 4). This volume 62 may be filled with a gas, or with a cushioning element that contains a gas or other fluid.

Figure 4:
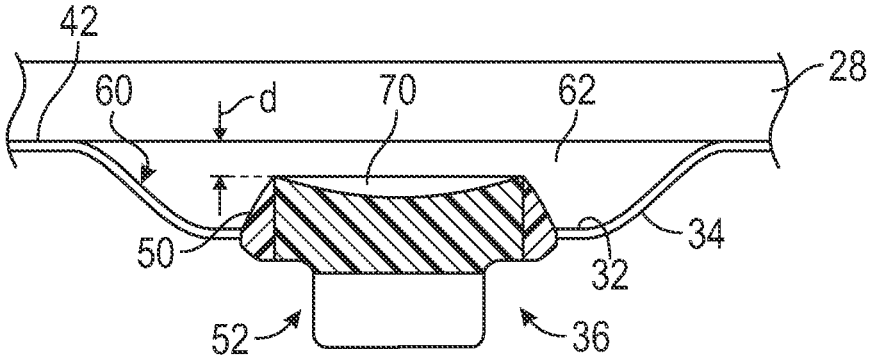
FIG. 4 is a schematic partial cross-sectional view of a cleat of a sole structure for a cleated article of footwear

In the embodiments shown in FIGS. 3-4, due to the standoff created by the recessed areas 60, together with the midsole 28 only being adhered/affixed to the interstitial bond surface 42 between the recessed areas 60, the total surface area of the bond surface 42 is less than the total surface area of the upper surface 40 of the ground engaging component 30.

The present design has the benefits of allowing the cushioning response at the cleats 36 to be controlled independently from the cushioning response of the midsole 28. Alternatively, in a sole component that has no midsole, but instead has a rigid or semi-rigid plate, the present design imparts a cushioning response where one did not previously exist. This imparted cushioning response of the ground engaging sole component 30 is a direct product of the material and structural stiffness imparted by the support layer 32 and substrate layer 34.

Referring again to FIG. 4, in one configuration, the upper surface 70 of the base portion 50 of the cleat 36 may be spaced from the midsole 28 (or other adjoining structure) by a minimum distance d that is greater than 0.00 mm, or greater than about 2 mm, or greater than about 5 mm. In this manner, the ground engaging component 30 may be permitted some positive amount that provides for compliance or deformation before the base portion 50 would otherwise contact or begin applying a stress/contact pressure to the midsole 28. Such a design may impart a two stage cushioning system, whereby the spring-force changes once the base portion is brought into contact with the midsole 28 via loading. This design may also serve to distribute the initial compression/ground contact force across a broader area to reduce point loading on the foot.

In other configurations, the upper surface 70 of the base portion 50 may initially be in contact with the midsole 28, and/or may impinge into the midsole 28 (i.e., under no-load conditions). In doing so, the midsole 28 may begin from a point of pre-loaded contact, thus providing an increased lateral stiffness to the cleat 36 (i.e., by anchoring the top portion to reduce moments that may be imparted by lateral contact with the ground engaging portion 52.

Figure 5:
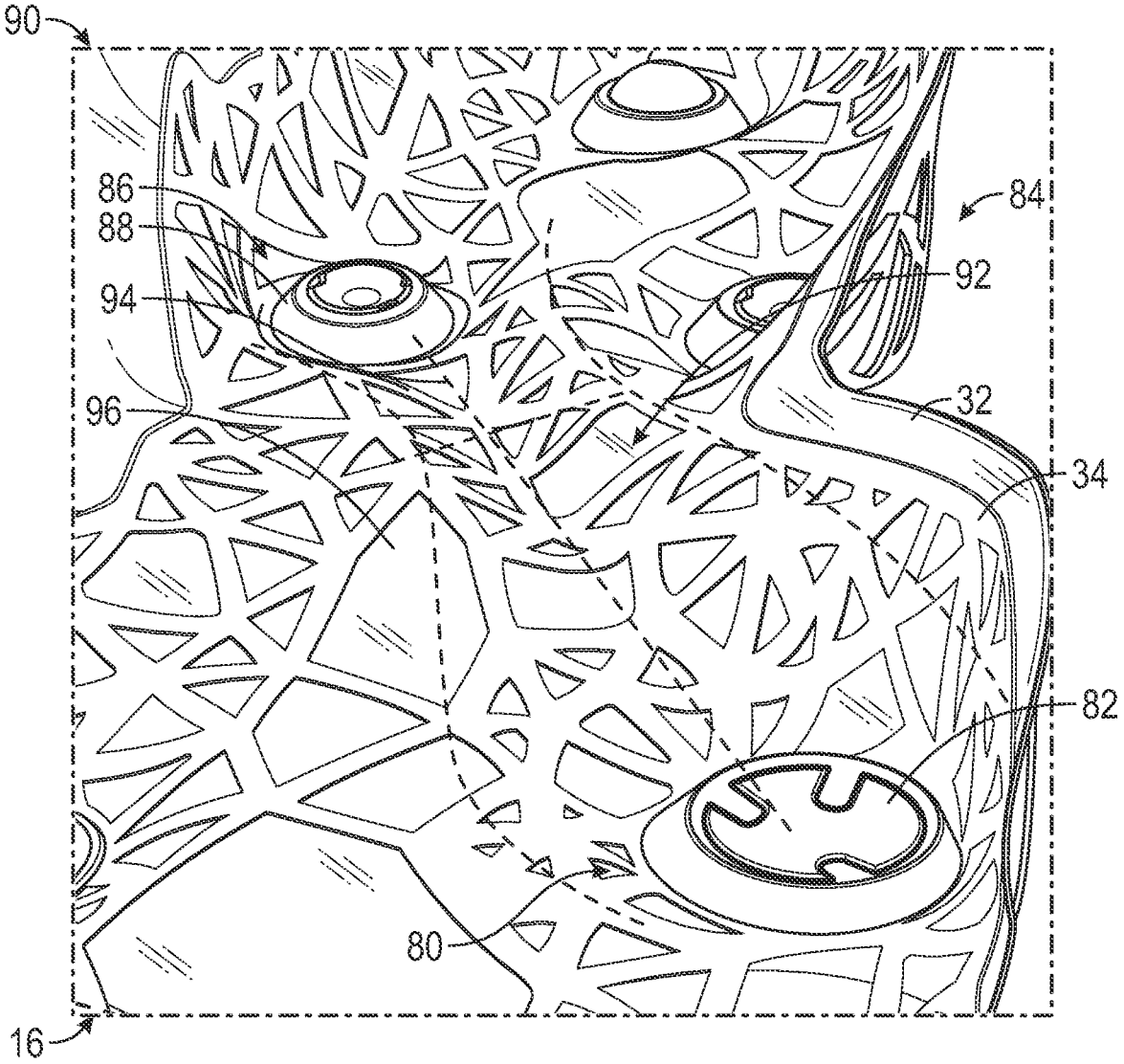
FIG. 5 is an enlarged top perspective view of a ground engaging sole component for a cleated article of footwear.

Referring to FIG. 5, in some embodiments, two or more of the recessed areas 60 may be interconnected via a contoured groove or channel 90 formed by the substrate layer 32 and/or support layer 34. As shown, in one configuration, a recess 80 surrounding a rear-most cleat 82 on the medial side 84 of the forefoot region 16 may be coupled to a recess 86 surrounding a forward-most cleat 88 on the lateral side 90 of the heel region 20 by a contoured channel 92. The channel 92 may have a channel axis 94 that extends along the deepest portion of the channel 92, where the channel 92 is recessed in a groundward direction relative to portions 96 of the substrate layer 32 on opposing sides of the channel axis 92.

In general, the channel 92 illustrated in FIG. 5 will provide the sole structure 12 with a greater degree of rigidity in the fore-medial to heal-lateral direction (i.e., along the channel axis 94), whereas it will still permit flexibility in the fore-lateral to heal-medial direction (i.e., at an angle to and/or orthogonal to the channel axis 94). Furthermore, in some embodiments, the substrate layer 32 within the channel 92 need not be separated from the midsole 28. Instead, the substrate layer 32 within the channel 92 may contact and be affixed to the midsole 28 to provide increased rigidity. Furthermore, in some embodiments, the channel 92 may be filled with a plate or other stiffening structure that is comparatively more rigid and/or stiff than a traditional midsole foam.

Figure 6:
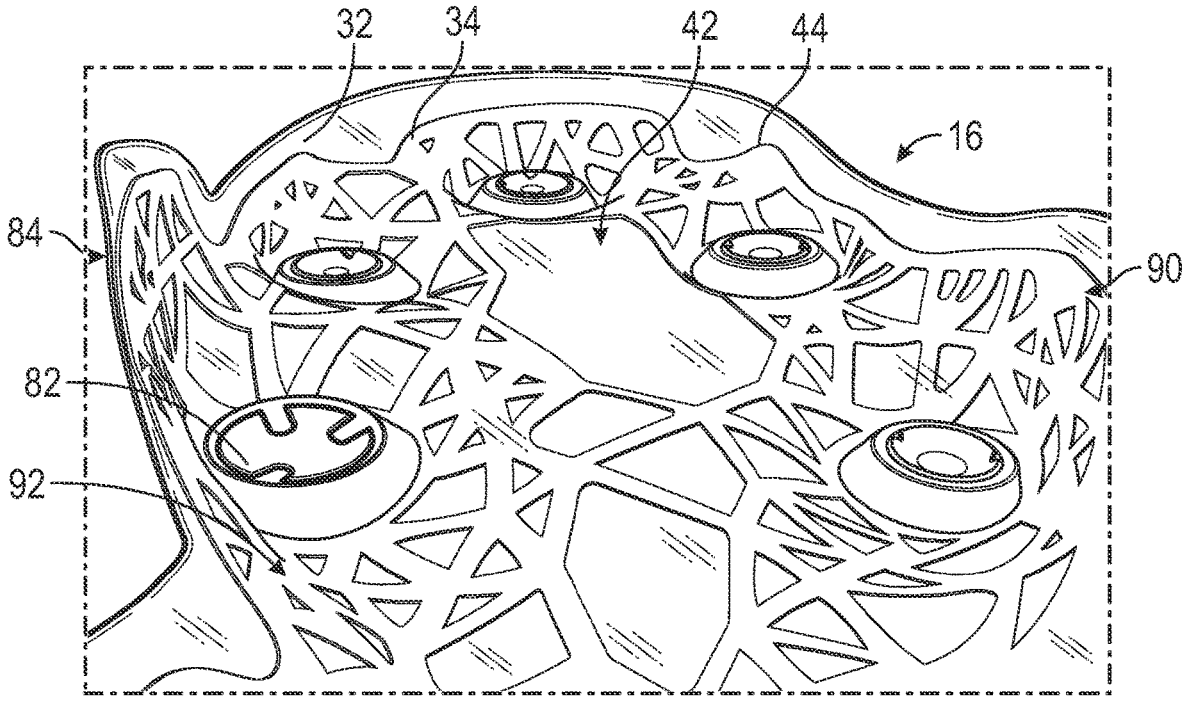
FIG. 6 is an enlarged top perspective view of a ground engaging sole component for a cleated article of footwear.
Figure 7:
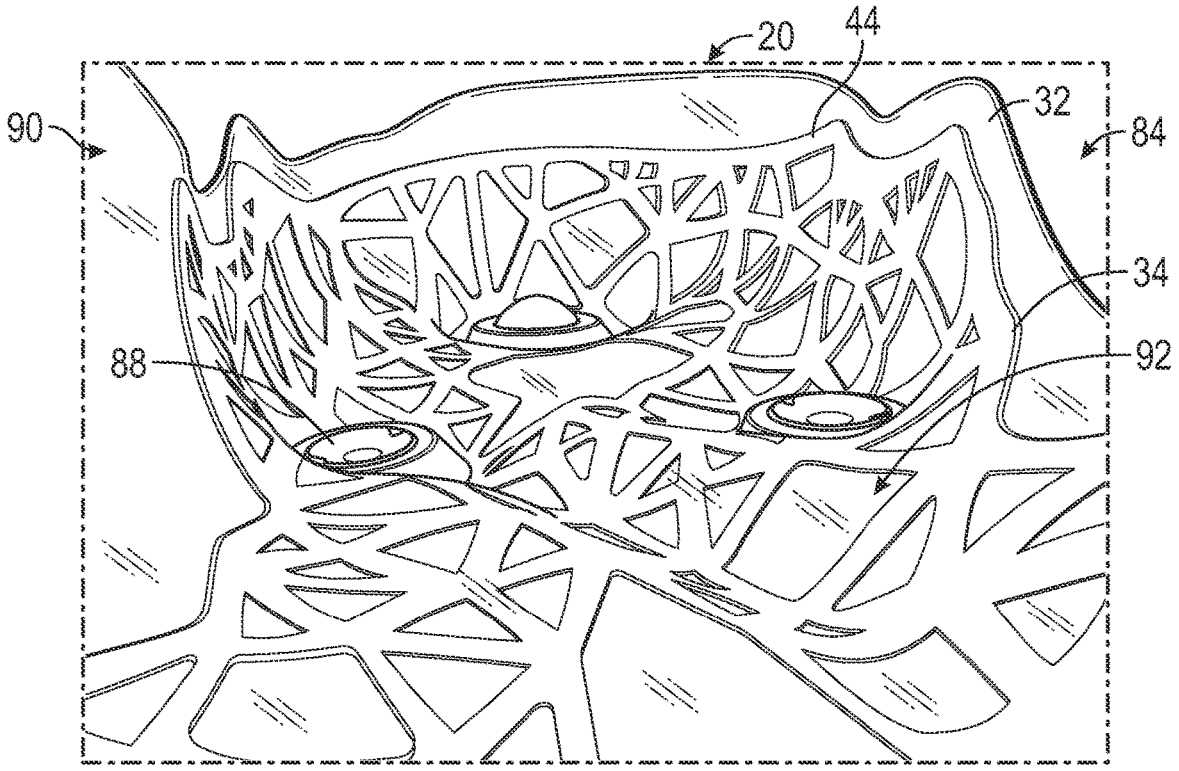
FIG. 7 is an enlarged top perspective view of a ground engaging sole component for a cleated article of footwear.

FIGS. 6-7 provide two additional views of the upper surface 44 of the ground engaging sole component 30. FIG. 6 illustrates the forefoot portion 16, as viewed from the heel portion 20, while FIG. 7 illustrates the heel portion 20, as viewed from the forefoot portion 16.

In some embodiments, each of the support layer 34 and the substrate layer 32 may be formed from unfoamed polymeric materials. The support layer 34, however, may have a comparatively greater hardness than the substrate layer 32. In one configuration, each of the support layer 34 and the substrate layer 32 may comprise a thermoplastic material, and in some embodiments, they may comprise the same thermoplastic material. In this manner, the two layers may more readily bond to each other when formed.

In one configuration, the structural properties and/or stiffness of the ground engaging sole component 30 may be tuned by altering the thickness, density, and/or geometric arrangement of the adjoining scaffold segments 40 of the support layer 34. In general, they may be arranged to provide greater structural support/stiffness around each of the cleat 36.

The invention claimed is:

1. A sole structure for an article of footwear having an upper adapted to receive a foot, the sole structure comprising:

a midsole having an upper surface and a ground-facing surface; and a ground engaging sole component affixed to the ground-facing surface of the midsole, the ground engaging sole component comprising:

a substrate layer comprising a polymeric sheet, and wherein:

the substrate layer forms a plurality of recessed areas, where within each recessed area, the substrate layer contours away from the midsole to define a volume between the substrate layer and the midsole, the substrate layer includes a bond surface that contacts and is secured to the midsole, and wherein the bond surface encircles each recessed area of the plurality of recessed areas;

a support layer joined with the substrate layer and operative to structurally reinforce the polymeric sheet; and a plurality of cleats, each cleat coupled to the support layer within a recessed area, and wherein each cleat is spaced apart from the midsole by a distance that is greater than 0.0 mm.

2. The sole structure of claim 1, wherein each cleat comprises a respective base portion and a ground engaging portion, the base portion at least partially extending between the support layer and the midsole.

3. The sole structure of claim 2, wherein the ground engaging portion comprises a metal blade or post.

4. The sole structure of claim 2, wherein the base portion of at least one of the plurality of cleats has an upper surface, opposite the ground engaging portion, that is concave relative to the midsole.

5. The sole structure of claim 1, wherein the polymeric sheet has a thickness of less than about 1.0 mm.

6. The sole structure of claim 1, wherein the support layer has a hardness that is greater than a hardness of the substrate layer.

7. The sole structure of claim 1, wherein the plurality of cleats comprises 8 cleats.

8. The sole structure of claim 1, wherein the sole structure further comprises a forefoot portion, a midfoot portion, and a heel portion; and wherein at least three of the cleats are in the forefoot portion.

9. The sole structure of claim 1, wherein the sole structure further comprises a forefoot portion, a midfoot portion, and a heel portion; and wherein at least three of the cleats are in the heel portion.

10. The sole structure of claim 1, wherein the support layer comprises a scaffold that includes a plurality of apertures defined between a plurality of adjoining scaffold segments.

11. The sole structure of claim 10, wherein the substrate layer extends across each of the plurality of apertures.

12. The sole structure of claim 1, wherein the support layer comprises a structure having a plurality of linear segments that are joined together to define a plurality of polygonal apertures; and wherein the substrate layer extends across each of the plurality of apertures.

13. The sole structure of claim 12, wherein the plurality of apertures comprises at least 100 apertures.

14. The sole structure of claim 12, wherein the plurality of apertures comprises between 100 and 300 apertures and the plurality of cleats comprises between 3 and 15 cleats.

15. The sole structure of claim 1, wherein the substrate layer and support layer are operative to flex within the recessed area such that the cleat within the recessed area contacts the midsole in response to an applied load.

* * * * *